United States Patent [19]

Plew

[11] Patent Number: 4,588,123

[45] Date of Patent: May 13, 1986

[54] SELF-SUPPORTING MAIL BOX

[76] Inventor: Randolph L. Plew, R.R. #3, Rd 150 N, Columbia City, Ind. 46725

[21] Appl. No.: 705,654

[22] Filed: Feb. 26, 1985

[51] Int. Cl.[4] ..... B65D 91/00

[52] U.S. Cl. ..... 232/39; 248/364

[58] Field of Search ..... 232/17, 39, 35; 248/364

[56] References Cited

U.S. PATENT DOCUMENTS 3,805,312 4/1974 Wu ..... 248/364

4,367,844 1/1983 Drummond ..... 232/39

4,416,414 11/1983 Edgerton ..... 232/39

4,498,621 2/1985 Diamond ..... 232/39

*Primary Examiner*—Gene Mancene

*Assistant Examiner*—David I. Tarnoff

*Attorney, Agent, or Firm*—R. D. Thompson

[57] ABSTRACT

A mailbox which includes a hollow supporting base extending therefrom. The base and mailbox are integrally molded into a unitary structure which positions the box at the correct delivery height. The box may have a false bottom to support the articles of mail, integrally formed handle, and means for supporting/positioning a flag. The integral base and box are stable and self-righting when the hollow base is filled with ballast.

15 Claims, 3 Drawing Figures

SELF-SUPPORTING MAIL BOX

BACKGROUND OF THE INVENTION

The present invention relates to receptacles for mail, papers, periodicals and the like and in particular to a rural mailbox with an integral therewith. Mailboxes for use in rural free delivery zones typically include means for supporting the mailbox on a post or other type of standard at a location adjacent a road. The post or other standard act as a means for locating the rural mailbox at the appropriate height for the mail carrier. These posts are buried into the ground in order to provide sufficient stability to the rural mailbox. The post or other support means typically must be replaced several times before the mailbox itself is replaced for reasons of nonserviceability. The support post may be broken off by errant vehicles, snow plows, roadside mowing equipment, or vandals. If the support post remains unbroken for any length of time and it is made of either wood or metal it will rot or corrode below ground level. Even if the post is not broken off, rotted or corroded they commonly become bent or deformed during use which causes the mailbox to be in an improper orientation with the roadway dust rendering the delivery of mail most difficult for the rural letter carrier.

The common rural mailbox formed of several pieces of sheet metal fastened together are inherently prone to rust. One especially vulnerable area is the bottom surface of the box where it is attached to the support post. Water accumulates in the bottom surface where the post attachment is, due to leakage of rain and condensation in the box. This interface between the post and mailbox corrodes most readily since the fasteners have breached any corrosion resistant coating which was applied to the outer surfaces of the sheet metal forming the box. Once the fastener poles become corroded it becomes necessary to replace the mailbox. One further disadvantage of the sheet metal rural mailbox is that it has several sharp edges which can cause injury to both users and innocent passers-by.

SUMMARY OF THE INVENTION

One aspect of the present invention is to provide a self-supporting mailbox comprising:

hollow rigid base depending from and being integrally formed with said box, said base extending generally perpendicular to the bottom to maintain said mailbox and its contents at a selected distance above the ground, said base having a basal plate and lateral surfaces forming a cavity therein, said basal plate being in contact with the ground and the cross-sectional area of the basal plate being greater than the cross-sectional area of the base directly adjacent the bottom of said box.

Another aspect of the invention is a method of manufacturing an integral mailbox and base unit comprising the steps of:

(a) introducing thermoplastic synthetic resin into a mold;
(b) forming the resin into an integral mailbox and base unit;
(c) cooling the unit; and
(d) removing the unit from the mold.

Yet another aspect of the invention is a method of deploying a self-supporting mailbox comprising the steps of:

(1) forming a mailbox and base into an integral hollow unit;
(2) deploying said unit at the desired location in contact with the ground; and
(3) filling a lower portion of said unit with ballast.

The present invention provides a self-supporting mailbox having an integrally formed base which maintains the mailbox at the proper height from the ground. The self-supporting mailbox is capable of sustaining impact by a vehicle and still returning to its original proper orientation with no damage to the mailbox. The mailbox body is impervious to corrosion and very durable thus eliminating upkeep and providing a long service life. Since the mailbox and support are integrally molded in a single piece there is formed a very secure weather tight combination which is capable of draining any water which may accumulate by condensation in either the box or the base to the ground. The appearance of the mailbox is aesthetically pleasing due to its streamlined features. The smooth lines minimize safety hazards due to the absence of sharp edges.

These and other features and advantages of the present invention will be further understood and appreciated by those skilled in the art by reference to the following written specification, claims and appended drawings.

DETAILED DESCRIPTION OF THE INVENTION

Figure 1:
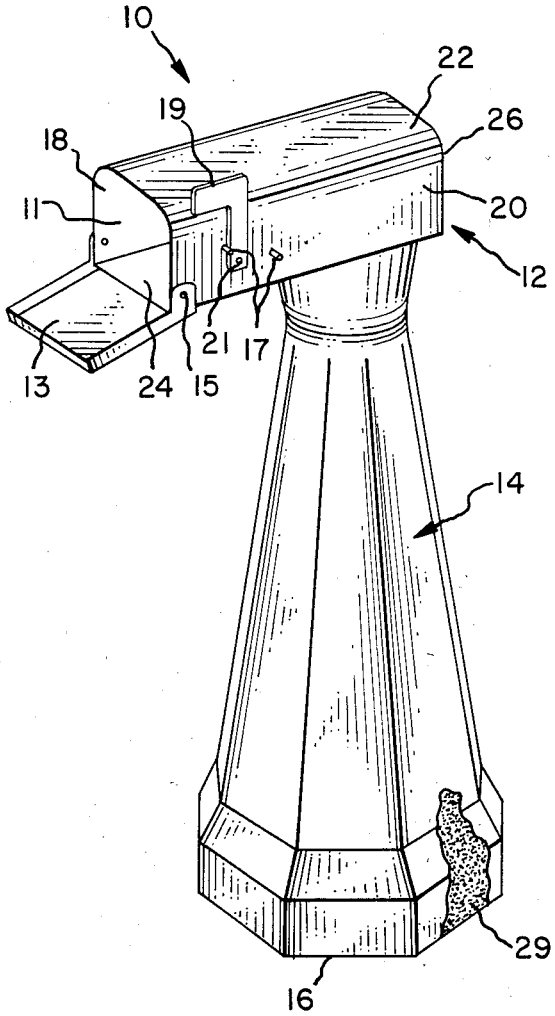
FIG. 1 is a side elevational view of a self-supporting mailbox of this invention.

Referring now to FIG. 1 the reference numeral 10 generally designates a self-supporting mailbox embodying the present invention comprising a box 12 and a rigid support base 14 both formed integrally and in one piece. The base 14 depends from the bottom 24 of the box 12 and is a hollow body sealed at the lower end by a basal plate 16 which contacts the ground. The cross-sectional area of the basal plate 16 must be greater than the cross-sectional area of the portion of the base 14 directly abutting the bottom 24 of the box 12. This effective area relationship must be retained in order to have sufficient ballast weight to assure upright orientation of the mailbox 10. This base area greater than the attachment area distinguishes the support from any known previous mailbox support configurations. The base 14 may open into the box 12 or the box 12 and base 14 may form separate hollow bodies depending upon the method of molding which is employed to manufacture the self-supporting mailbox 10. The preferred form of the invention is one in which the base 14 not only depends from the lower portion of the box 12, but actually opens into its lower portion to allow access to the hollow cavity in the base 14 from the box 12. The box 12 and base 14 are preferably molded in a single piece from a corrosion and impact resistant thermosetting or thermoplastic synthetic resin. A preferred class of materials is the polyolefins of 1 to 6 carbon atoms which may be employed as homopolymers or as copolymers. Representative of these polyolefins is the polyethylenes, polypropylenes, poly-4-methyl pentene, polyhexene.

Among the polyethylenes suitable materials include low density polyethylene (LDPE), linear low density polyethylene (LLDPE) and high density polyethylene (HDPE). The preferred polyolefin is polyethylene and the preferred polyethylene is linear low density LLDPE and HDPE owing to their slightly better impact resistance and rigidity. Other thermoplastic resins which may be useable are the polyvinyl chlorides (PVC) which may be considered a preferred material due to its superior weathering capabilities. It is stressed that any resin may be used either reinforced or unreinforced if it has suitable weathering, corrosion and impact resistance. Reinforcement may be added to the synthetic resin in the form of fine chopped fibers such as glass, nylon, polyester, rayon, carbon, etc. It is understood that other compounding ingredients may be included with the synthetic resins including colorants, antidegradants, fillers, ultraviolet stabilizers, plasticizers and other conventionally used compounding additives.

Any suitable molding technique may be utilized for the fabricating of the integral body which constitutes the box 12 and base 14. Known techniques include injection blow molding, injection molding, slush molding, rotational molding, dip molding and it is understood that these methods are representative only and any suitable manufacturing technique may be employed. The manufacturing technique chosen is dependent in one sense on the type of synthetic resin being utilized to form the structure.

Figure 3:
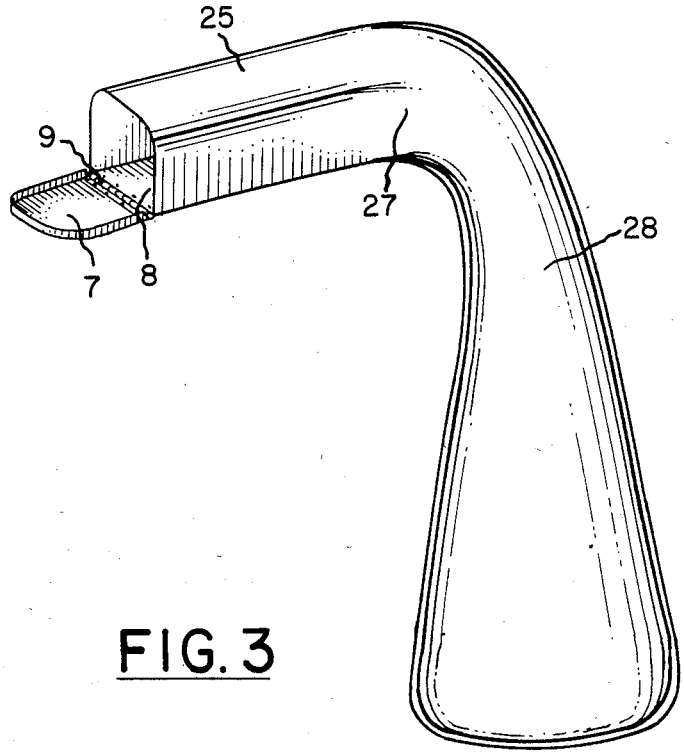
FIG. 3 is a mailbox having a hinged door and a base depending from the rear wall of the mailbox.

FIG. 1 illustrates a preferred form of the box 12 wherein the box is generally a hollow body having a pair of side walls 18 and 20, a top 22 and a bottom 24. The base 14 abuts and is integrally formed with the bottom 24 in the embodiment illustrated in FIG. 1. As shown in FIG. 3 the base 28 may also depend from either one of the side walls or the rear wall 26 27 if the configuration is desirable. It should be noted that in depending from rear wall 26 27 the base portion may be set back allowing a larger degree of overhang to the box 25. This configuration might be desirable for a particular type of installation where additional set back from the road surface for the base is desirable.

Figure 2:
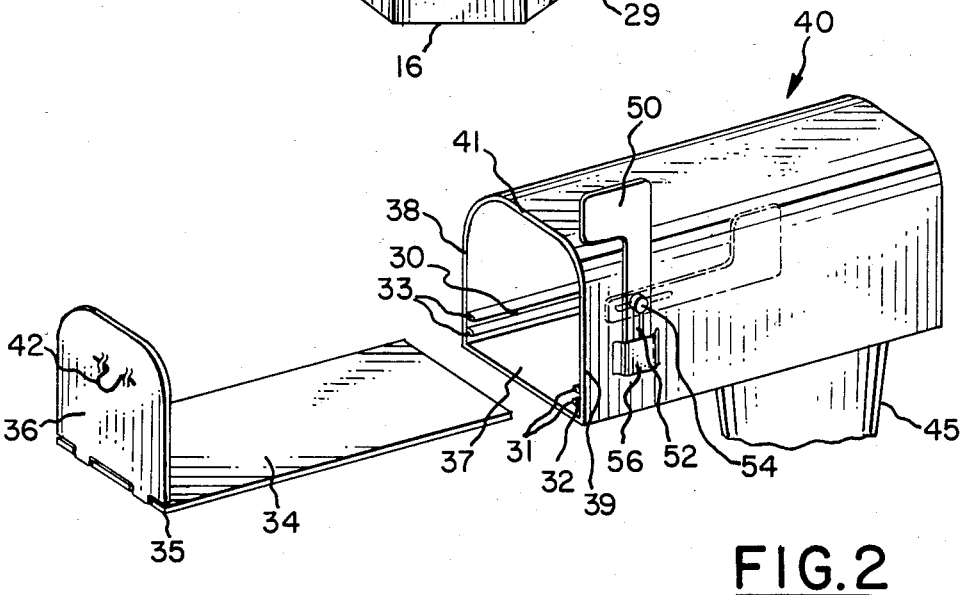
FIG. 2 is a perspective view of an embodiment of the invention employing a false bottom-hinged door combination insert.

Although a rectangular box is shown in FIG. 1, a box 40 having side walls 38, 39 which blend smoothly with the top to form an arched upper surface 41 much as a common rural delivery box as shown in FIG. 2 may be used as well as any other shape. FIG. 2 best shows the channels 30 and 32 which are formed integrally with the side walls 38 and 39 respectively. The channels 32 and 30 are formed by pairs of parallel ribs 31 and 33 which are inwardly projecting extending horizontally parallel to the bottom 24 of the box 12. These channels 30 and 32 form the means for holding in place a false floor 34 which may be optionally provided as a part of the box for the purpose of maintaining the mail off of the true bottom 37. The floor 34 prevents any moisture from contacting the mail and further provides a surface for depositing the mail and the like on when the base 45 depends from and opens into the bottom 37.

A false floor 34 may optionally be fitted with a door 36 hinged directly thereto by a hinge 35. The resulting assembly may be positioned in channels 30 and 32. A means for limiting the horizontal movement of the false floor 34 once it is engaged fully into the channels 30 and 32 may optionally be provided. The floor 34 may snap into a lip (not shown) molded into the rear of the box, or the means for limiting horizontal movement may be mechanical in nature including various fasteners, clips, pivots and screws.

A signal flag is generally included as required by the postal service. A simple means for maintaining flag in a horizontal and vertical position is shown in FIG. 1 wherein a plurality of outwardly protruding molded dimples 17 are provided in the side wall 20. The flag 19 rotates on a pivot 21 to allow it to be in a horizontal or a vertical position. In order to put the flag 19 into a vertical position it is simply pulled outward until the outwardly protruding dimple 17 is cleared, the flag may then be put in the vertical position. The dimples 17 restrict the downward rotational motion of the flag 19. FIG. 2 shows another method for providing for the horizontal and vertical positioning of the flag 50. A slot 52 is provided in the flag 50 around the pivot point 54 and a molded channel 56 is provided in the box 40 just below the pivot point such that the flag 50 may be rotated on the pivot point 54 to a vertical position. The whole flag would then slide downward owing to the slot thus engaging the bottom portion of the flag in the provided channel 56. Many other configurations are well known in the art and may be provided either by integrally molding the necessary hardware onto the side wall or providing fasteners or mechanical means for attaching the flag assembly.

In FIG. 1, the door 13 is mounted on a suitable means for pivoting, such as hinges 15, to provide a weather-tight seal for the open end 11 of the box 12. The door 13 and hinge 15 work cooperatively to provide a means for sealingly closing the open end 11 of box 12. The door may be dimensioned to fit within the open end. Or as shown in FIG. 1, the door may be dimensioned to fit around the outside of the box 12 to cover the open end 11. FIG. 2 shows an alternative preferred configuration in which the hinge 35 is attached directly to the false floor 34, and the door 36 works cooperatively to form a weather-tight seal. Of course, the hinge 35 may be of any suitable type. The door is provided with a handle 42 either molded into the face of the door 36 or as an appendage to the door. FIG. 3 shows a door 7 hinged to the bottom 8 of the box 25 by hinge 9.

In use, the base 14 is partially or completely filled with any suitable ballast material 29. The hollow body of the base 14 accommodates the ballast material which is introduced preferably through the box 12 where the base 14 opens directly into the bottom 24 of the box. This opening is ideally suited to introducing rocks, sand, concrete or any other material to provide weight to the self-supporting mailbox 10. The basal plate 16 of the base 14 serves to contain the ballast and may optionally be provided with a plurality of drainage holes for the purpose of draining any water which may accumulate in either the box portion or the base portion during outdoor service. The ballast not only serves to provide weight to assure upright orientation of the structure it also provides additional rigidity to the base to improve impact resistance. The interface between the basal plate 16 and the side walls of the base 14 is preferably an arcuate interface. If an arcuate interface is provided, the self-supporting mailbox assembly 10 will also be self-righting. This self-righting feature is quite advantageous in circumstances where an errant vehicle or vandal collides with the box 10. The mailbox will be knocked over but upon the passage of the vehicle will resume its upright position owing to the substantial weight of the ballast and the arcuate joining surface between the side wall and basal plate 16 of the base 14. Similarly, when snowplows push snow banks into the self-supporting mailbox 10 the box may be temporarily pushed out of the desired orientation with the road but will return automatically to its prescribed positioning upon the removal of the snow mass.

The integrally molded box and base combination provides a structure which is self-righting when ballast is introduced into the base and further provides for a corrosion free, tough and damage resistant structure which provides heretofore unequalled duration of service life. The attractive lines of the self-supporting mailbox and the ability to select color in order to highlight the mailbox or if the user wishes to blend the mailbox into its surroundings is a very desirable feature.

In the foregoing description it will be readily appreciated by those skilled in the art that modifications may be made to the invention without departing from the concepts disclosed herein.

I claim:

1. A self-supporting mailbox comprising:

a unitary, hollow body including a hollow box and hollow rigid base having an opening provided therebetween, said opening facilitating the addition of a ballast material to the base, said hollow box having an open end through which mail may be inserted and withdrawn from said box, a rear wall opposite said open end, a bottom and opposed side walls; and said hollow rigid base depending from and being integrally formed with said box, said base extending generally perpendicular to the bottom to maintain said mailbox and its contents at a selected distance above the ground, said base having a basal plate and lateral surfaces forming a cavity therein, said basal plate being in contact with the ground and the cross-sectional area of the basal plate being greater than the cross-sectiional area of the base directly adjacent the bottom of said box.

2. A self-supporting mailbox as set forth in claim 1 further comprising a means for selectively closing said open end of said box.

3. A mailbox as set forth in claim 1 wherein said base contains ballast in its interior.

4. A mailbox as set forth in claim 2 wherein said means for selectively closing said open end is a door hinged to said bottom of said box.

5. A mailbox as set forth in claim 1 wherein said base depends from and opens through said bottom of said box at a substantially perpendicular relationship thereto.

6. A self-supporting mailbox as set forth in claim 1 wherein said base depends from said rear wall and extends generally perpendicular to said bottom.

7. A self-supporting mailbox of claim 1 wherein said base and box are integrally formed of a thermosetting or thermoplastic synthetic resin.

8. A self-supporting mailbox as set forth in claim 1 further comprising a signal flag pivotably mounted on one of said side walls.

9. A self-supporting mailbox as set forth in claim 1 wherein said opposed side walls each include a pair of spaced apart inwardly protruding ribs thus forming a horizontal channel therebetween substantially parallel to said bottom of said box.

10. A mailbox as set forth in claim 9 further comprising a planar false floor dimensioned to slide into said horizontal channels in the opposed side walls to form a mail support surface spaced apart from said bottom.

11. A self-supporting mailbox as set forth in claim 10 wherein said door is attached to said false floor by a means for hinging.

12. A self-supporting mailbox as set forth in claim 11 wherein said door further comprises a handle adapted for selectively opening and closing said door.

13. A self-supporting mailbox as set forth in claim 4 wherein said door further includes a means for securely retaining said door in a closed position over said open end of said box.

14. A method of manufacturing an integral mailbox and base unit formed as a unitary, hollow body having an opening between said mailbox and base adapted for addition of a ballast material therethrough into said base, said method comprising the steps of:

(a) introducing thermoplastic synthetic resin into a mold shaped to form a single, unitary body including a mailbox portion and a base portion with an opening therebetween;

(b) forming the resin into an integral mailbox and base unit;

(c) cooling the unit; and (d) removing the unit from the mold.

15. A method of deploying a self-supporting mailbox formed as a unitary, hollow body having an opening between a box and a base adapted for addition of a ballast material therethrough into said base comprising:

deploying said self-supporting mailbox at a desired location in contact with and on top of the ground; and pouring said ballast material through said opening provided in said unitary, hollow body between said box and said base until said base is at least partially filled with ballast.

* * * * *